US005388335A

United States Patent [19]

Jung

[11] Patent Number: 5,388,335

[45] Date of Patent: Feb. 14, 1995

[54] DEVICE FOR ADJUSTING A SIGHT

[76] Inventor: Theo Jung, am Alten Garten 7, 5204 Lohmar 1, Germany

[21] Appl. No.: 44,973

[22] Filed: Apr. 8, 1993

[30] Foreign Application Priority Data

Apr. 9, 1992 [DE] Germany ..... 9204927[U]

[51] Int. Cl.[6] ..... F41G 1/32

[52] U.S. Cl. ..... 33/260; 33/241; 33/248; 33/252

[58] Field of Search ..... 33/241, 252, 254, 259, 33/260, 233, 247, 248; 42/101, 103; 356/251, 252; 434/19, 21, 22

[56] References Cited

U.S. PATENT DOCUMENTS

| | | | |
|---|---|---|---|
| 2,135,774 | 11/1938 | Tilden | 33/248 |
| 2,306,972 | 12/1942 | Meisel | 33/247 |
| 2,445,595 | 7/1948 | Bengert | 33/247 |
| 2,493,254 | 1/1950 | Leupold | 33/248 |
| 2,563,849 | 8/1951 | Lebherz | 33/248 |
| 3,867,764 | 2/1975 | Dunmire et al. | 33/241 |
| 3,979,848 | 9/1976 | Ackerman, Jr. | 33/248 |
| 4,152,754 | 5/1979 | deFilippis et al. | 42/103 |
| 4,192,075 | 3/1980 | Strahan | 33/233 |
| 4,939,863 | 7/1990 | Alexander et al. | 42/103 |
| 5,282,594 | 2/1994 | Huang | 33/233 |

FOREIGN PATENT DOCUMENTS

| | | | |
|---|---|---|---|
| 2154332 | 9/1985 | United Kingdom | 33/241 |

*Primary Examiner*—Thomas B. Will

*Attorney, Agent, or Firm*—Robert P. Simpson; Michael L. Dunn

[57] ABSTRACT

A device for precisely adjusting an optical sight on a small arm or a hand firearm, characterized by an adjusting plate (2) mounted on the arm and having a slot, a sight holder (3) with a bottom plate (3[a]) having a plug (16) formed at its bottom side which when being in engagement with the slot allows a horizontal turn and a vertical tilt of the sight holder (3) relative to the adjusting plate (2), and a set-up for fixing the sight holder (3) in a definite turning and tilting position with respect to the adjusting plate (2).

11 Claims, 5 Drawing Sheets

DEVICE FOR ADJUSTING A SIGHT

BACKGROUND OF THE INVENTION

The invention relates to a device for adjusting a sight on a small arm or a hand firearm.

The known optical sight or luminous spot sight serves for sighting and adjusting the sight very precisely. It is switched on by a slider switch arranged to be easily handled, and projects a luminous punctual target mark into the center of the point of impact. Up to now this sight is pasted on the arm, i.e. its adjustment on the arm is practically impossible.

For the optimum utilization of the capability of this sight the "shooting-in" of the arm with use of this sight is necessary, i.e. the sight is to be aligned so that the shot hits precisely where the marksman sees the target marking point. For the adjustment the sight must be capable of being traversed (horizontally) and tilted axially (vertically) in order to increase the sighting accuracy stepwise from shot to shot and to fix the sight on the arm when the optimum sighting accuracy is achieved.

SUMMARY OF THE INVENTION

The object of the present invention is to provide a device for adjusting an optical sight on a small arm or a hand firearm which device allows "shooting-in" the arm using this sight so that the advantages of the optical sight can be utilized in the best possible way when using the arm.

According to the invention this object is achieved by an adjusting device which is characterized by an adjusting plate to be mounted on the arm and having a slot, a sight holder with a bottom plate having a plug formed at its bottom side which when being in engagement with said slot allows a horizontal turn and a vertical tilt of the sight holder relative to the adjusting plate, and means for fixing the sight holder in a definite swiveling and tilting position relative to the adjusting plate.

The adjusting plate is detachably mounted on the arm in the same way as e.g. a notch or a sighting telescope. Then the sight holder with the optical sight is put on the adjusting plate so that the plug of the bottom side engages with the slot. Then the sight holder can still be horizontally, i.e. round a vertical axis perpendicular to the sight direction, turned and vertically, i.e. round a horizontal axis perpendicular to the sight direction, tilted. The arm is now shot-in using the optical sight, i.e. the horizontal turn position and the vertical tilt position are corrected from shot to shot until the maximum accuracy of sighting is achieved. Subsequently, the sight holder is fixed with the fixing means in the thus reached position.

According to the preferred embodiment of the adjusting device of the invention the adjusting plate has a circular socket, a disk is rotatably received in the socket, said disk having a slot originating from its edge and having a length allowing the slot to be narrowed under pressure, and means are provided for blocking the rotary movability of the disk in the socket and for narrowing the slot. The sight holder with the optical sight is placed onto the adjusting plate so that the plug on the bottom-side engages with the slot of the circular disk, said means for blocking the rotary movability of the disk in the socket and for narrowing the disk slot at first being not effective so that the sight can be horizontally turned and vertically tilted within narrow limits. After having shot-in the arm into maximum sighting accuracy the rotary movability of the disk is blocked whereby the lateral adjustability of the sight is excluded, and simultaneously the disk slot is narrowed whereby the plug of the bottom plate engaging with the slot is jammed and by this the tilt position of the sight is fixed. Generally the disk slot is to be dimensioned so that its narrowing can be achieved by pressure forces which can be generated by tightening one or more screws.

Preferably, with this embodiment of the adjusting device of the invention the disk socket is a plate aperture, and the means for rotary blocking and slot narrowing comprises a slot extending from the edge of the plate aperture to the edge of the adjusting plate and a screw traversing the slot, said screw on the one side of the slot being supported on the adjusting plate and on the other side of the slot being screwed into the adjusting plate. The slot is narrowed by screwing the screw into a taphole provided in the adjusting plate on the other side of the slot, and by this the diameter of the circular disk socket is reduced so that the socket is put against the rim of the disk and by this its rotatability is barred. Simultaneously or subsequently the clamping force is also transferred onto the disk and narrows its slot so that the plug of the sight holder becomes non-displaceable in the slot and by this the tilting position of the sight is fixed. Consequently, the direction of the sight can be fixed in both planes being at right angles to each other.

With a somewhat modified embodiment of the device the disk socket is formed tub-shaped in the adjusting plate, and the means for rotary blocking and slot narrowing is at least one taphole with a screw which traverses the wall of the tub-shaped socket and acts on the rim of the disk. In this case pressing the disk in the socket for the purpose of fixing it is not achieved by narrowing the socket per se but by one, preferably two screws which within the socket range can be screwed through lateral tapholes into the adjusting plate, thereby coming into engagement with the rim of the disk and consequently on the one hand barring the rotatability of the disk and on the other hand compressing the disk slot so far that the plug of the sight holder extending into the slot is clamped in the slot so that the tilting position of the sight holder together with the sight is fixed with respect to the adjusting plate and the arm.

Conveniently, the length of the slot amounts to a least about 50%, preferably 75 to 95% of the diameter of the disk. Particularly, the length of the slot in the disk can be between 85 and 90%, e.g. 87.5% of the disk diameter. At any rate the length of the slot has to be so large that the forces which can be exerted by means of screw(s) effect a sufficient narrowing of the slot and consequently the clamping of the plug.

Conveniently, the plug of the bottom plate is formed oblong corresponding to the slot. With this the plug of the bottom plate is partially in a form-locking engagement with the slot. A longitudinal displacement of the plug in the slot and consequently of the sight on the arm is excluded in this manner.

With a further embodiment of the invention a cutout is formed in the adjusting plate behind the disk socket, a second plug engaging with the cutout with a clearance is arranged at the bottom side of the bottom plate of the sight holder, and means for restricting the plug clearance in the cutout are provided in the adjusting plate. With this engagement the capability of the sight holder to be horizontally swiveled and vertically tilted with respect to the adjusting plate and the arm, respectively, can be limited. This is advantageous if e.g. a person unskilled with arm testing and adjusting, e.g. the owner of the arm himself tests and adjusts the arm with use of the sight because the said means for restricting the plug clearance allow a precision adjustment.

Preferably two tapholes are formed in the adjusting plate and have screws screwed in as means to restrict the plug clearance in the transverse direction, i.e. perpendicularly to the sighting direction, and tapholes opening into the cutout and being opposite to each other in the direction of the transverse clearance of the second plug. The horizontal movement of the sight can be restricted by these two lateral screws. Especially the horizontal precise adjustment is possible with these screws.

Furthermore, a taphole with a screw is conveniently provided in the rear portion of the adjusting plate as means to restrict the plug clearance in the elevating direction, said taphole being arranged approximately in the center plane of the adjusting plate and opening into the cutout, and an inclined plate is formed at the rear side of the second plug on which plane the screw comes to bear when being screwed in.

With this depth adjusting screw a precision adjustment of the tilting position of the sight is possible. When the screw comes to engagement with the inclined plane, by screwing it in further the sight is tilted to the rear, i.e. its sighting point is lifted. When the desired optimum tilting position of the sight is achieved in this manner, this position is fixed by tightening the rotary disk and fastening the front plug in the slot of the disk.

The cutout for the second plug can also be formed tub-shaped, and a taphole opening into the cutout and containing a screw can be provided in the bottom of the tub-shaped cutout as a means to restrict the plug clearance in the depth direction. The lower stop point of the plug is lifted and the tilting clearance of the sight is correspondingly reduced by screwing the screw into the taphole.

With another embodiment of the device of the invention the sight holder is supported on the adjusting plate by means of an axle traversing the slot and the oblong plug in the transverse direction in order to achieve a swiveling motion with clearance, the means for constricting the slot are tapholes with screws, said tapholes being opposite to each other and extending from the edge of the adjusting plate to the slot, and lugs with tapholes and adjusting screws which can be brought in contact with the topside of the adjusting plate, are provided at the front end and the rear end of the bottom plate. With this embodiment the means for fixing the sight holder can be used to restrict the swiveling and tilting clearances, too. The axle bearing is provided in such a manner that not only the sight holder can be tilted relative to the adjusting plate, but the axle bearing also allows a horizontal swiveling within limits. This is rendered possible because the axle has a smaller diameter than the bore and/or the axle is crowned in the zone of the plug bore. The fixing in the horizontal swiveling position is achieved by the two screws in 0 the adjusting plate, and the fixing in the tilting position is achieved by means of the screws provided in the lugs of the bottom plate.

Conveniently, a tongue corresponding to the dovetailed groove on the arm is formed at the bottom side of the adjusting plate. In this manner it is possible to exchange the notch usually mounted on the arm by dovetailing for the device of the invention with the optical sight.

Conveniently, the sight holder is formed as a sleeve having a square cross-section. As the sight has a square, especially a rectangular section, too, the sleeve of the sight holder is adapted to the section of the sight holder. The sight holder can be inserted into the sleeve. The sleeve has a cutout for the sight switch arranged to be easily gripped. Conveniently, the sight is glued in the sight holder. This has the advantage that the sight cannot be displaced in the holder which otherwise would be possible as a result of the shock with the shot, especially with arms large in bore. The invention is specified herebelow in more detail in connection with the drawings.

BRIEF DESCRIPTION OF THE DRAWINGS

FIG. 7 is a cross-section of the adjusting plate taken along the line VII—VII of FIG. 6 with the sight holder put-on;

FIG. 9 is a cross-section taken along the line IX—IX of FIG. 8 with the sight holder put-on.

DETAILED DESCRIPTION OF THE INVENTION

Figure 1:
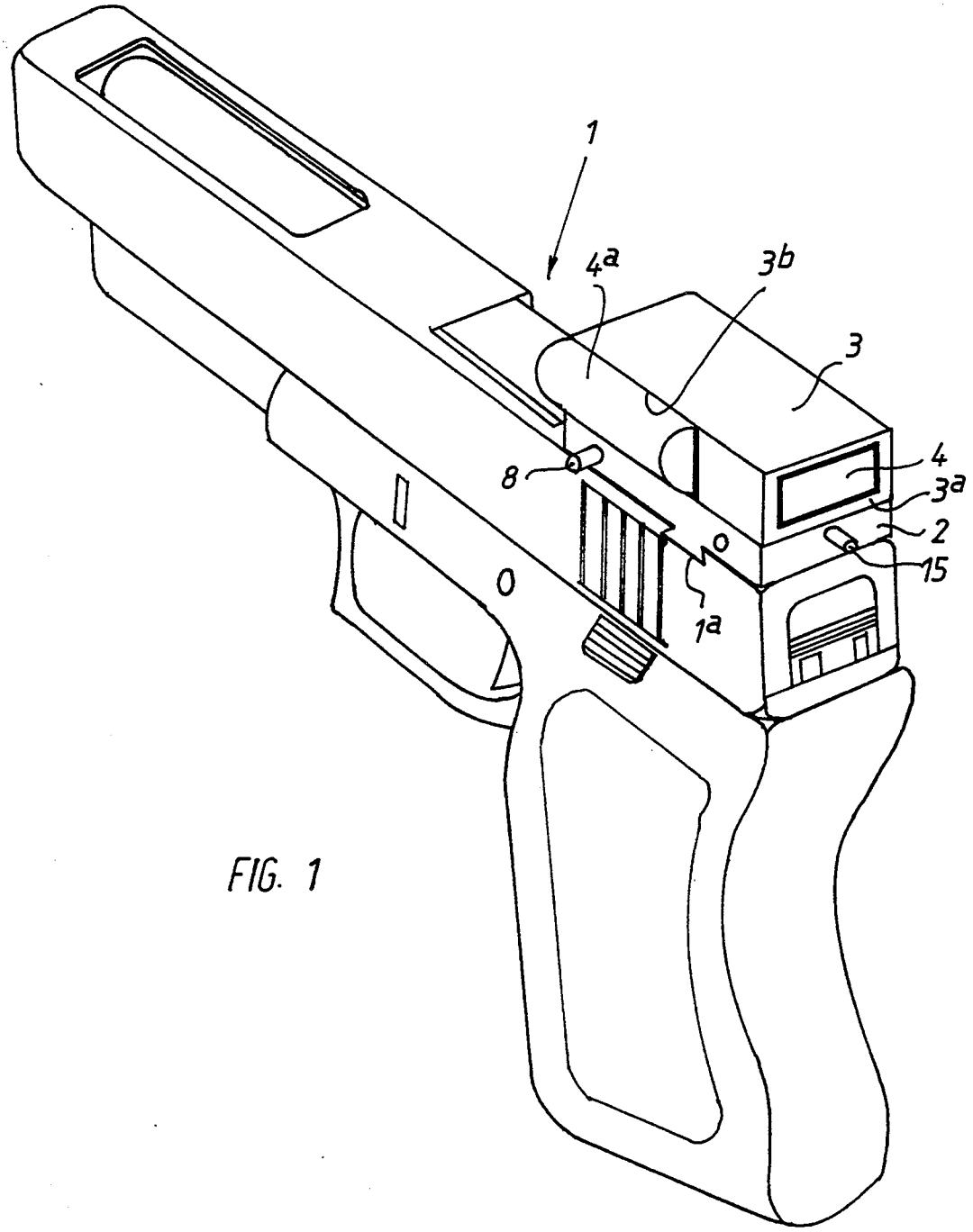
FIG. 1 is a small arm with an optical sight mounted on the arm by means of the device of the invention.

The small arm shown in FIG. 1 has a transverse slot $1^a$ of dovetailed cross-section as usual on the top side with a sight notch being usually inserted into the slot. Instead of the sight notch the adjusting device 2,3 according to the invention is now inserted into the slot $1^a$, and the device itself holds the sight 4.

It is seen that the sight holder (3) is formed as a sleeve having a square cross-section section and a cutout ($3^b$) for the switch ($4^a$) of the sight (4).

Figure 2:
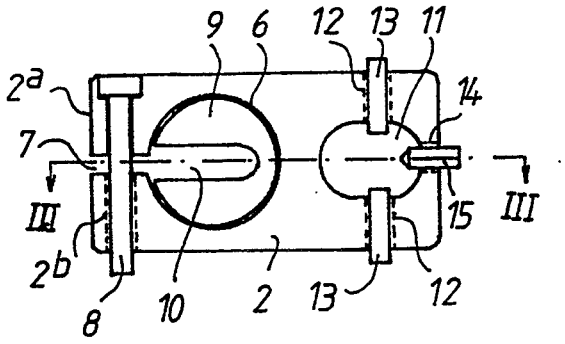
FIG. 2 is a horizontal section of the adjusting plate of the adjusting device shown in FIG. 1.
Figure 3:
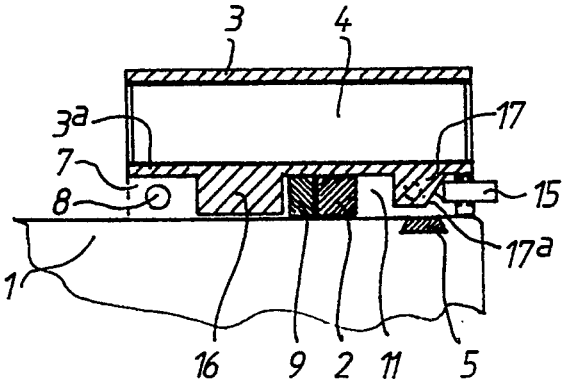
FIG. 3 is a cross-section of the adjusting plate taken along line III—III of FIG. 2 with the put-on sight holder and mounted on the arm.

The embodiment of the adjusting device shown in the FIGS. 1 to 3 comprises an adjusting plate 2 having on its bottom side a transversely extended dovetailed feather 5 which is inserted into the transverse slot $1^a$. The adjusting plate 2 has a circular cutout 6. A slot 7 extends from the front edge $2^a$ of the plate 2 to the circular cutout 6. A screw 8 is screwed into a tapped hole $2^b$ provided in the plate 2 on the one side of the slot 7, and is supported with its head in the plate 2 on the other side of the slot 7 so that the slot 7 and consequently the cutout 6 can be narrowed by screwing in the screw 8. A rotary disk 9 is pivotally arranged in the cutout 6, said disk being usually rotatable in the cutout 6, but can be blocked in its rotatability by tightening the screw 8. The rotary disk 9 on its part has a slot 10 extending diametrically from the disk edge beyond the disk center into the disk.

Figure 4:
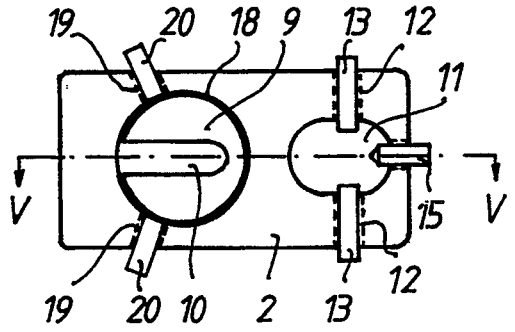
FIG. 4 is a horizontal section corresponding to FIG. 2 of a somewhat modified second embodiment of the adjusting plate.
Figure 5:
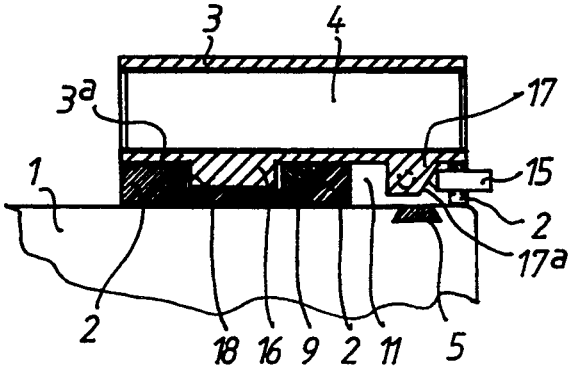
FIG. 5 is a section of this adjusting plate taken along the line V—V of FIG. 4 with the sight holder and sight mounted on the arm.

A second cutout 11 is provided in the plate 2 behind and spaced from the cutout 6, said cutout 11 being preferably likewise a plate hole. A taphole 12 opening into the cutout 11 is provided at each of both long sides of the plate 2 in the range of the cutout 11. Screws 13 are screwed into the tapholes 12. Furthermore, a taphole 14 having likewise a screw 15 screwed-in is provided at the rear end, said taphole 14 being arranged in the longitudinal center axis of the plate 2 and opening into the cutout 11. As is apparent from FIG. 3 a sight holder 3 formed as a sleeve having a rectangular cross-section is put on the plate 2. A first oblong plug 16 projecting downwards which is in engagement with the elongated disk slot 10 is formed at the bottom surface of the bottom plate $3^a$ of the sight holder 3. Furthermore, a second plug 17 extending into the cutout 11 is formed at the bottom surface of the bottom plate $3^a$ near to its rear end. Due to the engagement of the oblong plug 16 with the slot 10 the sight holder 3 with the sight 4 can be horizontally swiveled on the plate 2 by a small angle which depends on how far the screws 13 are screwed into the tapholes 12. The horizontal angular freedom of the sight can be restricted by the screws 13 whereby adjusting the sight is facilitated particularly for the unskilled owner of the arm. The tilting position of the sight holder 3 and of the sight, i.e. its inclination to the adjusting plate 2 and accordingly to the shot axis, can be precisely adjusted by the screw 15. For this purpose the plug 17 has an inclined plane $17^a$ on its rear side, said screw 15 coming into contact with this plane when being screwed into the taphole 14. When farther screwing in the screw 15 its cone slides on the plane $17^a$ and causes lifting the rear end of the sight holder 3 and thus lowering the sight marking. Consequently, a precision adjustment of the line of sighting is possible by means of the screws 13 and 15 so that the sight marking can be brought to coincidence with the impact point of the shot. It is evident for the skilled person that although the facilities 11–15, 17 allow the precise adjustment, the experienced expert can as well conduct it only with the facilities 9, 10 and 16. When the sight is precisely adjusted in this manner by means of the facilities 9, 10, 16 and possibly additionally by means of the facilities 11–15, 17, this adjustment is fixed by screwing the screw 8 farther into its taphole $2^b$, thereby narrowing the slot 17 and jamming the rotary disk 9 and the plug 16. The FIGS. 4 and 5 correspond completely to the FIGS. 2 and 3, but show a somewhat modified embodiment of the plate 2. In this case the socket of the rotary disk 9 consists of a tub-shaped cylindrical recess 18 in the plate 2 into which the circular disk 9 is fitted with a small clearance. The thickness of the rotary disk 9 is so large that its top side is flush with the top side of the plate 2. The center slot 7 at the front side and the screw 8 are omitted. The plate 2 contains a taphole 19 5 opening more or less perpendicularly into the recess 18 and provided with screws 20 at each of its longitudinal sides for jamming the rotary disk 9 in the recess 18.

It is evident that both embodiments correspond to each other except for the type of clamp fixing of the sight holder 3. When the sight holder 3 with the sight 4 is adjusted, fixing is carried out by screwing the screws 20 into their tapholes 19 whereby the disk 9 is jammed in the tub-shaped socket 18 and the elongated plug 16 of the sight holder is jammed in the disk slot 10.

Figure 6:
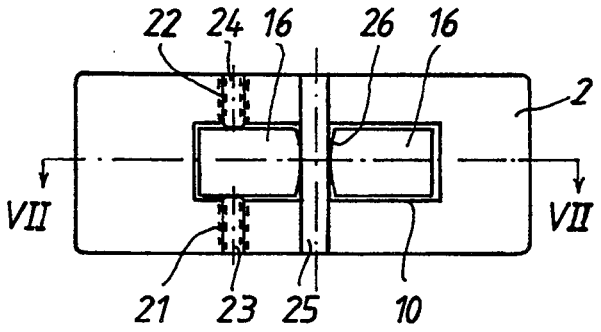
FIG. 6 is a horizontal section of the adjusting plate of a third embodiment of the adjusting device of the invention.
Figure 7:
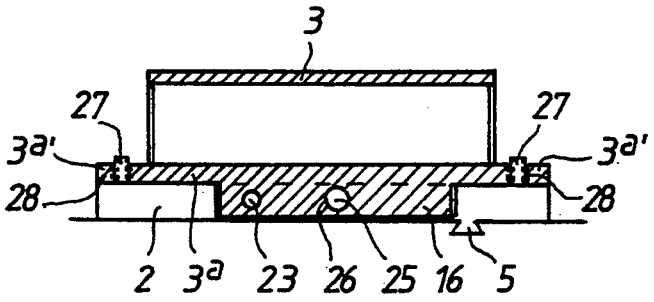

With the embodiment of the adjusting device shown in the FIGS. 6 and 7 the plate 2 has directly a slot-type longitudinal cutout 10 which is penetrated by an axle 25. Two aligned tapholes 21, 22 extend from the edge of the plate 2 to the cutout 10. Adjusting screws 23 and 24 are contained in the tapholes 21 and 22, respectively. According to FIG. 7 the bottom plate $3^a$ of the sight holder 3 is put onto the plate 2, said elongated plug 16 being in engagement with the slot 10. The plug 16 has a crowned bore 26 as can be seen from FIG. 6. Moreover, it is possible to make the diameter of the bore 26 larger than that of the axle 25. As the elongated plug 16 is spaced from the walls of the slot 10, not only can the sight holder 3 be tilted relative to the adjusting plate 2 around axle 25, but it can also be swiveled around the center axis perpendicular to the drawing plane (FIG. 6) within narrow limits when the adjusting screws 23, 24 are screwed back into their tapholes. At the front and back the bottom plate $3^a$ has lugs $3^{a'}$ with tapholes 28 provided with screws 27. By means of the screws 27 the tilting range of the sight holder 3 around axle 25 can be restricted, and a definite tilting position of the sight holder relative to the adjusting plate 2 can be fixed. By means of the screws 23, 24 a definite horizontal swivel position can be fixed.

Small arms and hand firearms including police arms and military arms can be equipped with an optical sight and the arm can be shot in using this sight in a short time and in a simple manner i.e. even by persons inexperienced with this, by means of the adjusting device of the invention. The performance of the arm can be considerably increased without additional mounting costs.

Figure 8:
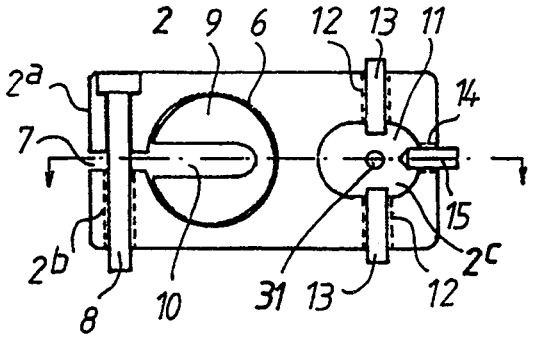
FIG. 8 is a horizontal section of the adjusting plate of a fourth embodiment of the adjusting device of the invention.
Figure 9:
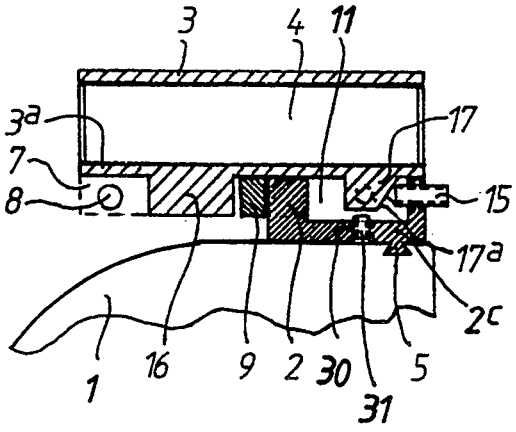

The embodiment shown in the FIGS. 8 and 9 correspond to the embodiment of the FIGS. 2 and 3 to a large extent. The cutout 11 of the adjusting plate 2 is however formed tub-shaped, and a taphole 30 with a set screw 31 is provided in the tub bottom $2^c$. The tilting of the sight holder to the rear is restricted by screwing the screw 31 into the cutout 11.

It is claimed:

1. A device for adjusting an optical sight on a small arm or a hand firearm, comprising:

an adjusting plate operatively arranged to be mounted on the arm and having a circular socket;

a rotary disk rotatably received in the circular socket and having a first slot extending from its edge;

a sight holder having a bottom plate containing a first plug on its bottom operatively arranged to engage said first slot, wherein said sight holder is arranged to rotate in a horizontal plane, relative to the adjusting plate, about a pivot point defined by the axis of rotation of said rotary disk within said circular socket, and is also arranged to tilt in a vertical plane relative to the adjusting plate; and, means for fixing the sight holder in a stable position by blocking rotary movement of the rotary disk in the circular socket and by clamping the first plug in the first slot, causing said first slot to narrow.

2. A device as recited in claim 1, wherein the circular socket is a plate aperture, and the means for fixing the sight holder comprises a second slot ending from an edge of the plate aperture to an edge of the adjusting plate and a screw traversing the second slot, said screw being supported on one side of the second slot by a bore in the adjusting plate and on the other side of the second slot being screwed into a tapped hole in the adjusting plate.

3. A device as recited in claim 1, wherein the circular socket is tub-shaped and the means for fixing the sight holder comprises a taphole with a screw which traverses the wall of the circular socket and acts on the edge of the disk.

4. A device as recited in claim 1 wherein the first plug is oblong which corresponds to the general shape of the first slot.

5. A device as recited in claim 1 wherein a cutout is formed in the adjusting plate proximate the circular socket, and a second plug engaging the cutout with clearance is arranged at a bottom side of the bottom plate of the sight holder, and further including means in the adjusting plate for restricting the clearance of the second plug in the cutout.

6. A device as recited in claim 5 wherein two tapholes are formed in the adjusting plate, which taphole contain screws which function to restrict said second plug clearance in a transverse direction, said tapholes opening into the cutout and being opposite to each other in the direction of the transverse clearance of the second plug.

7. A device as recited in claim 5 wherein a taphole with a screw is provided in a rear portion of the adjusting plate and functions as a means to restrict the clearance of the second plug in an elevating direction, said taphole being arranged in a center plane of the adjusting plate and opening into the cutout, wherein an inclined plane is formed at a rear side of the second plug, on which plane said screw comes to bear when being screwed in.

8. A device as recited in claim 5 wherein the cutout is formed tub-shaped and a taphole opening into the cutout and containing a set screw is provided in the bottom of the tub-shaped cutout as a means to restrict the clearance of the second plug in the depth direction.

9. A device as recited in claim 1 wherein a tongue corresponding to a dovetailed groove on the arm is formed at a bottom side of the adjusting plate.

10. A device as recited in claim 1 wherein the sight holder is formed as a sleeve having a square cross-section and a cutout for a switch of the sight.

11. A device as recited in claim 1 wherein the sight is glued into the sight holder.

* * * * *